US010842331B1

(12) United States Patent
Ebrahimi Afrouzi

(10) Patent No.: US 10,842,331 B1
(45) Date of Patent: Nov. 24, 2020

(54) DEBRIS COMPACTING SYSTEM FOR ROBOTIC VACUUMS

(71) Applicant: Ali Ebrahimi Afrouzi, San Jose, CA (US)

(72) Inventor: Ali Ebrahimi Afrouzi, San Jose, CA (US)

( * ) Notice: Subject to any disclaimer, the term of this patent is extended or adjusted under 35 U.S.C. 154(b) by 0 days.

(21) Appl. No.: 16/053,171

(22) Filed: Aug. 2, 2018

Related U.S. Application Data

(63) Continuation-in-part of application No. 14/887,542, filed on Oct. 20, 2015, now Pat. No. 10,064,528.

(51) Int. Cl.
*A47L 9/10* (2006.01)
*A47L 9/14* (2006.01)

(52) U.S. Cl.
CPC ..... *A47L 9/108* (2013.01); *A47L 9/14* (2013.01); *A47L 2201/00* (2013.01)

(58) Field of Classification Search
CPC ..... A47L 9/108; A47L 9/12; A47L 2201/00; A47L 5/22; A47L 2201/024
See application file for complete search history.

(56) References Cited

U.S. PATENT DOCUMENTS 2,895,564 A 7/1959 Borie, Jr.
5,193,453 A 3/1993 Lundy
5,768,988 A 6/1998 Meloni
7,007,598 B1 3/2006 Patras
7,874,446 B2 1/2011 Spivey et al.
8,572,799 B2 11/2013 Won et al.
8,584,886 B1 11/2013 Ellman
8,741,013 B2 6/2014 Swett et al.
10,064,528 B1 * 9/2018 Ebrahimi Afrouzi ... A47L 9/108
2006/0048491 A1 3/2006 Pineschi
2006/0123749 A1 6/2006 Park
2008/0263816 A1 10/2008 Oh et al.
2008/0264014 A1 10/2008 Oh et al.
2008/0264016 A1 10/2008 Oh et al.
2012/0255140 A1 10/2012 Tomita et al.
2013/0067681 A1 3/2013 Hyun
2013/0312215 A1 11/2013 Kim et al.
2014/0130290 A1 * 5/2014 Jang ..... A47L 9/108 15/319
2015/0107047 A1 * 4/2015 Hyun ..... A47L 9/108 15/352
2017/0215666 A1 * 8/2017 Won ..... G05D 1/0225

* cited by examiner

*Primary Examiner* — Robert Clemente

(57) ABSTRACT

A system for compacting debris collected within a robotic vacuum debris container to allow more space for incoming debris. The volume of collected debris is reduced by pressure plates pressing the debris against surfaces so that the debris container may hold a greater mass of debris. The system allows robotic vacuums to operate for longer periods of time before requiring maintenance by a user to empty the debris container.

20 Claims, 3 Drawing Sheets

DEBRIS COMPACTING SYSTEM FOR ROBOTIC VACUUMS

CROSS-REFERENCE TO RELATED APPLICATIONS

This application is a continuation in part of U.S. non-provisional patent application Ser. No. 14/887,542, filed Oct. 20, 2015 and claims the benefit of provisional patent application Ser. No. 62/066,881, filed Oct. 21, 2014 by the first named inventor.

FIELD OF INVENTION

The present invention relates to a system and method for compacting debris within a debris container of a robotic vacuum.

BACKGROUND OF INVENTION

Many innovations in home-cleaning devices have reduced the amount of work involved in maintaining clean floors. Hand-operated vacuums eventually gave rise to robotic vacuums that perform the task of vacuuming debris from a workspace automatically. Most robotic vacuums contain a storage area for collected debris that must be periodically emptied by a user. Emptying the debris container is usually the most labor-intensive and unpleasant task necessary to maintain a robotic vacuum. Debris within a debris container is often comprised of a lot of dust, hair, and other materials that have a large volume but not a lot of mass. Thus, debris can take up a lot of space in a debris container if it is voluminous. A need exists for a method to compact such debris within a debris container so that the robotic vacuum may operate for longer periods of time between debris container emptyings. A need exists for a method to reduce the amount of work required to maintain a robotic vacuum.

SUMMARY OF INVENTION

It is a goal of the present invention to provide a method for compacting debris inside of a robotic vacuum debris container.

It is a goal of the present invention to provide a method to reduce the frequency with which a robotic vacuum debris container must be emptied.

It is a goal of the present invention to decrease the amount of human labor required to maintain a robotic vacuum.

It is a goal of the present invention to increase the autonomy of a robotic vacuum.

The present invention achieves the aforementioned goals through a debris compacting system that periodically compresses debris collected inside of a robotic vacuum debris container. An electric motor propels a plate that moves from one side of the debris container to the other, compacting collected debris against the debris container wall. The process results in more available space for incoming debris in the debris container.

DETAILED DESCRIPTION OF THE INVENTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Various embodiments are described below, including methods and techniques. The disclosure described herein is directed generally to a system for compacting debris within a debris container of a robotic vacuum.

As understood herein, the term "robotic vacuum" may be defined generally to include one or more autonomous devices having communication, mobility, vacuuming and/or processing elements. For example, a robotic vacuum may comprise a casing or shell, a chassis including a set of wheels, a motor to drive wheels, a receiver that acquires signals transmitted from, for example, a transmitting beacon, a processor, and/or controller that processes and/or controls motor and other robotic autonomous or cleaning operations, network or wireless communications, power management, etc., one or more clock or synchronizing devices, a vacuum motor to provide suction, a debris dustbin to store debris, a brush to facilitate collection of debris, and a means to spin the brush.

Generally, one or more plates are provided within a debris container of a robotic vacuum and are moved within the debris container against collected debris to decrease the volume of and thereby compress collected debris.

In the preferred embodiment, a plate is periodically propelled by an electric motor and set of gears along guiding tracks inside the debris container of a robotic vacuum.

In some embodiments, a debris container will include a filter frame, an impeller disposed under the filter frame to draw air from outside of said debris container into said debris container and an air filter.

Figure 1:
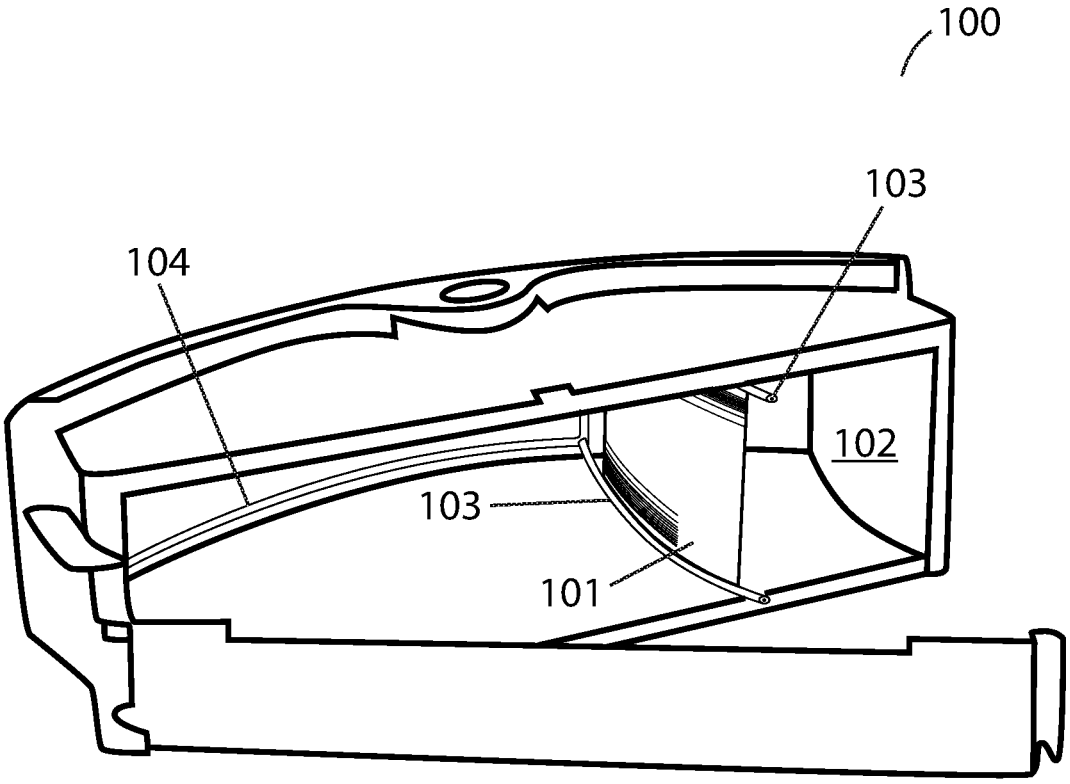
FIG. 1 illustrates a debris compacting system inside of a robotic vacuum debris container embodying features of the present invention.

Referring to FIG. 1, a robotic vacuum debris container 100 is illustrated. A plate 101 is provided within the debris container to press debris against the walls 102 of the debris container to make more room for incoming debris. In some embodiments, a plurality of plates may be provided. In some embodiments, plates may press debris against other plates (rather than debris container walls) to compress debris. In some embodiments, plates may be made from rigid, inflexible materials. In some embodiments, plates may be made from flexible materials. The system is also provided with a means to guide plate movement. In the example shown, bars 103 at the top and bottom of the plate guide the plate along tracks 104 within the debris container. An electric motor (not shown) and gear set (not shown) power the movement of the plate. It should be noted that other methods of plate movement are possible without departing from the scope of the invention.

In some embodiments, plate movement may occur at regular intervals and be actuated by a timer.

In some embodiments, plate movement may be manually actuated by a user.

In some embodiments, plate movement may be actuated automatically by a debris sensor when the amount of debris detected within the debris container reaches a predetermined threshold.

In the preferred embodiment, the system further comprises a resistance sensor, which halts debris compression when resistance against the plate or plates reaches a predetermined threshold.

Figure 2A:
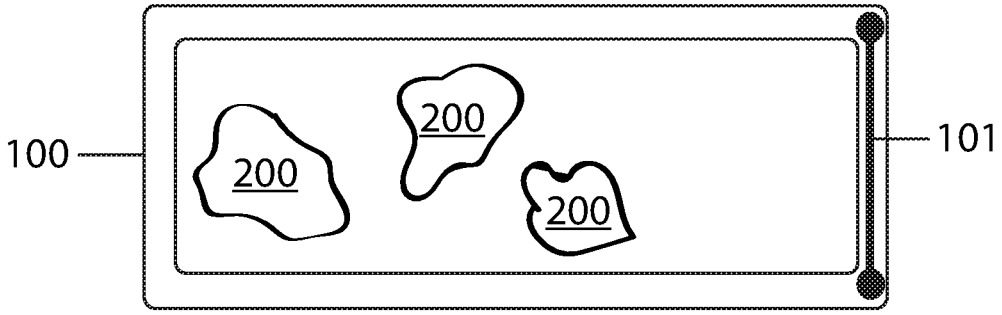
FIG. 2 illustrates a possible movement pattern of a compacting plate inside a robotic vacuum debris container embodying features of the present invention.
Figure 2B:
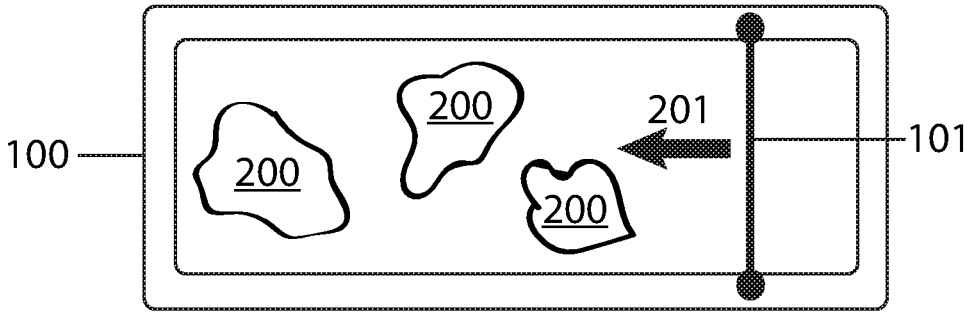
Figure 2C:
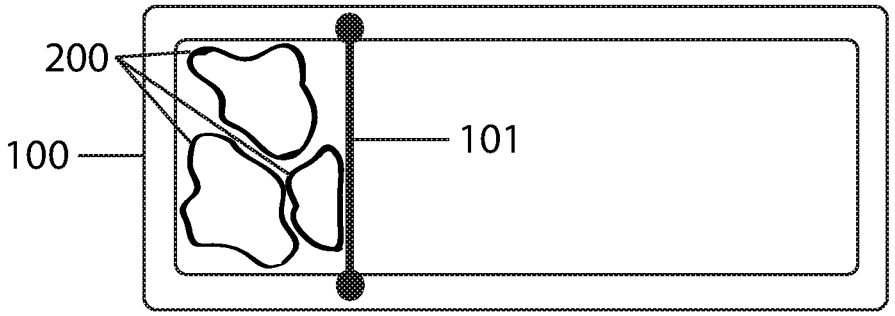
Figure 2D:
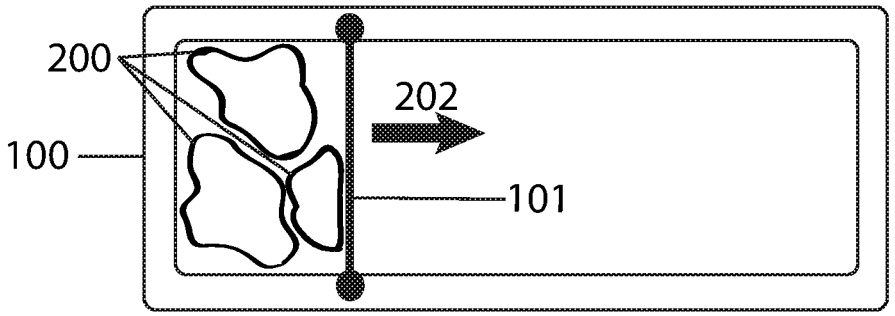

Referring to FIGS. 2A, 2B, 2C and 2D, an overhead view of one possible plate movement pattern is illustrated. As should be understood, numerous other plate movement patterns are possible without departing from the scope of the invention. Referring to FIG. 2A, in the example shown, the plate 101 starts at an initial position on a first side of the debris container 100. In this position, the plate has not yet compacted the debris 200 within the debris container. Referring to FIG. 2B, when plate movement is actuated, the plate 101 moves toward the opposite wall of the debris container 100 in a direction 201 to begin compacting the debris 200. In a next step illustrated in FIG. 2C, the plate 101 stops movement toward the opposite wall of the debris container 100 when resistance against the plate from the compacted debris 200 reaches a predetermined threshold. In a next step illustrated in FIG. 2D, the plate 101 moves in a direction 202 back to the original starting position on a first side of the debris container 100, leaving the debris 200 compacted.

In some embodiments, two or more plates may be provided to compress debris. The number of plates and the movement pattern of the plate or plates may vary and are not limited except by the practical limitations of the particular robotic vacuum debris container for which they are designed.

Plate movement is not limited to a direction perpendicular to the plane of the work surface; a plate could be devised to move vertically, compressing debris upward or downward, or in any other direction relative to the plane of the work surface.

In some embodiments, a method for compacting debris inside of a wrapper are utilized. As the debris is compacted, the debris is forced into a wrapper for easy disposal by the user. In some embodiments the wrapper is a foil wrapper. In other embodiments a paper wrapper is utilized. In yet other embodiments a plastic material may be utilized. Other variations are possible.

Figure 3:
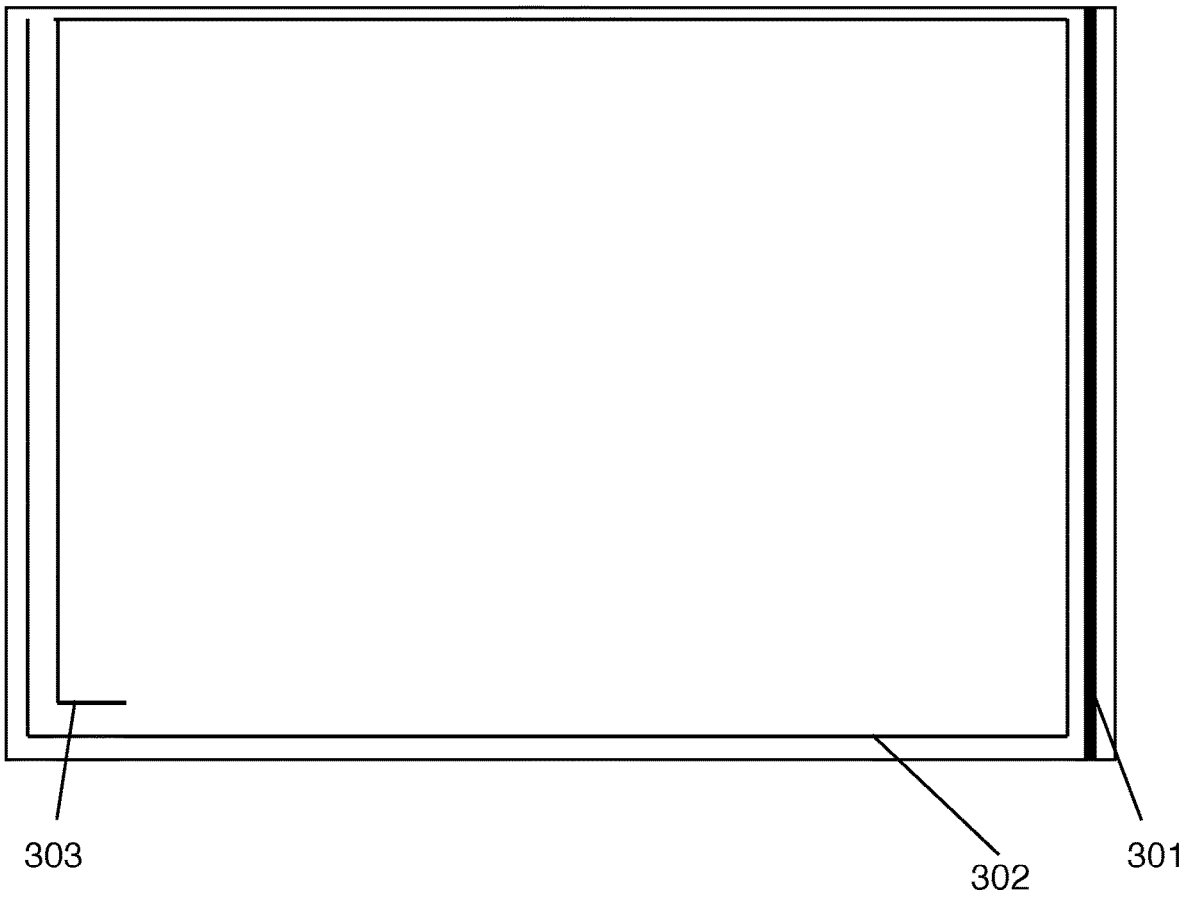
FIG. 3 illustrates a possible arrangement of a wrapper inside of a debris compactor.

FIG. 3 illustrates a possible arrangement of a wrapper placed inside of a debris compactor. The wrapper is placed when the container is empty, the compactor plate 301 is shown on the right. The wrapper 302 is placed within the perimeter of the container. The wrapper is overlapped 303 so that when the compactor plate compresses and the wrapper compresses along with the dust, the wrapper does not become unraveled.

In embodiments when the dustbin is empty, the wrapper is placed inside of the dustbin to coat the edges. The wrapper is placed so as to cover all edges of the dustbin in order to capture all dust inside of the wrapper. As the dust is compacted, the wrapper is pushed inwards, until the wrapper is closed into a small compact shape with the dust contained inside. Thereafter the compacted dust is easily disposed of. In embodiments, the shape of the compacted dust can be in a variety of forms inside of the wrapper. The shape can be that of a ball or circular shape, it can be an elongated shape, it can take the shape of a square or rectangle. What is important is not necessarily the shape but rather that the dust is compacted within the wrapper. In some embodiments the wrapper is placed ahead of cleaning time by the user. In other embodiments, the wrapper is placed inside by the docking station when the mobile robotic device docks at the docking station.

I claim:

1. A robotic vacuum comprising:
- a chassis;
- a set of wheels coupled to the chassis;
- at least one motor to drive the set of wheels;
- a processor;
- a vacuum motor to suction debris from a surface;
- at least one brush;
- at least one brush motor to rotate the at least one brush;
- a debris container to receive and store debris;
- at least one plate that moves from a first side of the debris container towards a second side of the debris container to compress stored debris;
- at least one track disposed along at least one wall of the debris container for movement guidance of the at least one plate;
- at least one notch coupled to the at least one plate and positioned within the at least one track to guide the at least one plate from the first side of the debris container towards the second side of the debris container; and
- an electric motor and gear set to power movement of the at least one plate.

2. The robotic vacuum of claim 1 wherein a wrapper is placed inside of the debris container and the wrapper is comprised of at least one of: foil, paper, and plastic.

3. The robotic vacuum of claim 2 wherein the wrapper and the debris are compacted by the at least one plate.

4. The robotic vacuum of claim 1 wherein movement of the at least one plate from the first side of the debris container towards the second side of the debris container occurs at regular intervals based on a timer.

5. The robotic vacuum of claim 1 wherein movement of the at least one plate from the first side of the debris container towards the second side of the debris container occurs when a debris sensor detects an amount of debris within the debris container above a predetermined threshold.

6. The robotic vacuum of claim 1 wherein movement of the at least one plate towards the second side of the debris container is halted when a resistance sensor detects a resistance above a predetermined threshold.

7. The robotic vacuum of claim 1 wherein the debris is compacted between the at least one plate and a wall of the debris container or another plate.

8. A method for compacting debris of a robotic vacuum comprising:
- collecting, with a vacuum motor, debris from a surface into a debris container; and
- moving, with an electric motor, at least one plate from a first side of the debris container towards a second side of the debris container to compact the debris collected within the debris container, wherein:
  - the at least one plate is actuated to compact the debris after at least one of:
    - a predetermined time interval determined using a timer;
    - receiving an instruction from a user input to compact the debris; and
    - a debris sensor detects a predetermined amount of debris within the debris container; and
  - the at least one plate is guided from a first side of the debris container towards the second side of the debris container using at least one track disposed along at least one wall of the debris container, wherein at least one notch coupled to the at least one plate is positioned within the at least one track.

9. The method of claim 8 wherein a wrapper is placed inside of the debris container.

10. The method of claim 9 wherein the wrapper and debris are compressed by the at least one plate.

11. The method of claim 9 wherein the wrapper is comprised of at least one of: foil, paper, and plastic.

12. The method of claim 8 wherein movement of the at least one plate towards the second side of the debris container is halted when a resistance sensor detects a resistance above a predetermined threshold.

13. The method of claim 8 wherein the at least one plate moves in a horizontal direction or a vertical direction.

14. The method of claim 8 wherein the robotic vacuum comprises:

a chassis;

a set of wheels coupled to the chassis;

at least one motor to drive the set of wheels;

a processor;

a vacuum motor to suction debris from a surface;

at least one brush; and at least one brush motor to rotate the at least one brush.

15. The method of claim 8 wherein the debris is compacted between the at least one plate and a wall of the debris container or another plate.

16. A system for compacting debris within a robotic vacuum, comprising:

a debris container disposed within a chassis of the robotic vacuum;

a wrapper placed inside of the debris container;

at least one plate positioned adjacent to a wall of the debris container;

an electric motor and gear set for powering movement of the at least one plate from a first side of the debris container towards a second side of the debris container, wherein the at least one plates compacts the debris after at least one of:

a predetermined time interval determined using a timer;

receiving an instruction from a user input to compact the debris; and a debris sensor detects a predetermined amount of debris is detected within the debris container.

17. The system of claim 16 wherein movement of the at least one plate towards the second side of the debris container is halted when a resistance sensor detects a resistance above a predetermined threshold.

18. The system of claim 16 wherein the at least one plate is guided from a first side of the debris container towards the second side of the debris container using at least one track disposed along at least one wall of the debris container, wherein at least one notch coupled to the at least one plate is positioned within the at least one track.

19. The system of claim 16 wherein the at least one plate moves in a horizontal direction or a vertical direction.

20. The system of claim 16 wherein the at least one plate moves in a horizontal direction or a vertical direction.

* * * * *